US010168654B2

(12) United States Patent
Sato et al.

(10) Patent No.: US 10,168,654 B2
(45) Date of Patent: Jan. 1, 2019

(54) IMAGE FORMING APPARATUS, IMAGE FORMING METHOD AND STORAGE MEDIUM

(71) Applicant: Konica Minolta, Inc., Chiyoda-ku, Tokyo (JP)

(72) Inventors: Yuya Sato, Hino (JP); Atsuto Hirai, Ikoma (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/340,246

(22) Filed: Nov. 1, 2016

(65) Prior Publication Data

US 2017/0123358 A1 May 4, 2017

(30) Foreign Application Priority Data

Nov. 4, 2015 (JP) ..... 2015-216254

(51) Int. Cl.
*G03G 15/00* (2006.01)
*G03G 21/00* (2006.01)

(52) U.S. Cl.
CPC ..... *G03G 15/5041* (2013.01); *G03G 15/50* (2013.01); *G03G 15/5058* (2013.01); *G03G 15/556* (2013.01); *G03G 21/0005* (2013.01); *G03G 21/0094* (2013.01); *G03G 15/6585* (2013.01)

(58) Field of Classification Search
CPC ..... G03G 15/0846; G03G 15/0848; G03G 15/5033; G03G 15/5041; G03G 15/5058; G03G 15/556; G03G 2215/00037
USPC ..... 399/24, 27, 49, 72, 346
See application file for complete search history.

(56) References Cited

U.S. PATENT DOCUMENTS

2004/0047642 A1* 3/2004 Kosuge ..... G03G 15/081 399/53
2006/0291885 A1* 12/2006 Radulski ..... G03G 21/0011 399/71
2013/0136471 A1* 5/2013 Lawton ..... G03G 15/0126 399/49
2015/0234312 A1* 8/2015 Funayama ..... G03G 15/065 399/55

FOREIGN PATENT DOCUMENTS

JP 2014-142472 A 8/2014

* cited by examiner

*Primary Examiner* — Benjamin R Schmitt
(74) *Attorney, Agent, or Firm* — Buchanan Ingersoll & Rooney PC

(57) ABSTRACT

An image forming apparatus includes an image carrying member, a developing device, a cleaning unit and a processor. The developing device performs development with a developer containing a toner and a lubricant. The processor obtains information on a lubricant amount in the developing device; obtains, with respect to each section formed by dividing a surface of the image carrying member in a rotating shaft direction of the image carrying member, a partial coverage from electrostatic latent image writing information for a predetermined period about the section; sets, for the section having the partial coverage of a predetermined value or less, a developer supply amount for a patch to be formed outside an image forming region on the image carrying member, based on the above information; and causes the developing device to supply the set developer supply amount so that the patch is formed.

15 Claims, 6 Drawing Sheets

IMAGE FORMING APPARATUS, IMAGE FORMING METHOD AND STORAGE MEDIUM

CROSS-REFERENCE TO RELATED APPLICATIONS

This application claims a priority under the Paris Convention of Japanese Patent Application No. 2015-216254 filed on Nov. 4, 2015, the entire disclosure of which, including the specification, claims, drawings and abstract, is incorporated herein by reference in its entirety.

1. FIELD OF THE INVENTION

The present invention relates to an image forming apparatus, an image forming method and a storage medium.

2. DESCRIPTION OF THE RELATED ART

There has been provided an electrophotographic image forming apparatus having a cleaning unit which removes the remaining toner on an image carrying member, such as non-transferred toner or toner left after the transfer. As the cleaning unit, for example, there has been known one employing a blade cleaning system, namely, a flat cleaning blade made of an elastic substance and removing the remaining toner on the image carrying member by pressing in contact with the surface of the image carrying member.

In recent years, for this type of electrophotographic image forming apparatus, smaller toner particles have been requested for high resolution images. As a method for obtaining such toner particles, for example, polymerization, exemplified by emulsion polymerization and suspension polymerization, is employed. However, the smaller the toner particles are, the higher the adhesion of the toner to the image carrying member is. This makes removal of the remaining toner on the image carrying member difficult. In particular, because the toner manufactured by the above-exemplified polymerization is composed of nearly spherical toner particles, the toner particles roll on the image carrying member and pass through the cleaning blade. That is, poor cleaning, called "passing through", tends to occur. This makes removal of the remaining toner on the image carrying member more difficult.

Further, when the toner particles passing through the blade exist, aggregations of the toner particles having the toner particles as nuclei are formed on the image carrying member, and thereby particle-shaped voids (particle-shaped noise) are generated in the region of a solid image formed on paper.

In order to deal with these quality problems of the "passing through" and the "particle-shaped noise", at present, a lubricant is supplied onto the image carrying member, and cleaning is performed in the state in which adhesion of the toner to the image carrying member is reduced. As a method for supplying a lubricant onto the image carrying member, there are a lubricant applying system and a toner externally-added system. In the lubricant applying system, a brush is made to abut a bar-shaped lubricant, and the lubricant is scraped away and supplied by the brush to the surface of the image carrying member. In the toner externally-added system, a toner image is formed with a developer containing a lubricant (lubricant external additive) and a toner, whereby the lubricant is supplied to the surface of the image carrying member.

In the toner externally-added system, the lubricant is present in a developing device in the state of adhering to the toner particles or floating, and when the toner is supplied to an image part (black part) in an image forming region on the image carrying member, the lubricant is also supplied onto the image carrying member. The lubricant is charged to have a polarity opposite to that of the toner, so that the lubricant is supplied to a background part (white part) in the image forming region on the image carrying member too. The lubricant supplied onto the image carrying member does not keep staying on the image carrying member but is collected from the image carrying member at the developing device, a transfer device, the cleaning unit and the like. Hence, the lubricant amount on the image carrying member changes according to the balance of the supply amounts and the collection amounts of these devices and unit(s).

The lubricant on the image carrying member is scraped away and collected by the cleaning blade with the toner particles and an external additive, which is different from the lubricant adhering to the surface of the toner particles, accumulating at the tip of the blade. At a low dot percentage part in an image on the image carrying member, the toner particles and the external additive reaching the cleaning blade are a little, and hence the amount of the toner particles and the external additive accumulating at the tip of the blade is insufficient, whereby power to scrape away and collect the lubricant on the image carrying member decreases. This makes the lubricant amount on the low dot percentage part on the image carrying member larger than that on a high dot percentage part thereon.

When the lubricant amount on the image carrying member is sufficient, the quality problems, such as the "passing through" and the "particle-shaped noise", are solved or relieved. However, when the lubricant amount is too much, another problem arises that the cleaning blade and the image carrying member come in close contact, which facilitates wear of the cleaning blade and thereby shortens life thereof.

Then, there has been proposed, for example, a technique of dividing the surface of the image carrying member into sections in its shaft direction, calculating, for each section, the dot percentage (partial coverage) of an image, and forming a patch outside the image forming region on the image carrying member with respect to the section having the dot percentage of the image being less than a threshold value. (Refer to, for example, Japanese Patent Application Publication No. 2014-142472.) This technique increases the supply amount of the toner particles and the external additive to the cleaning blade at the low dot percentage part on the image carrying member and prevents decrease in the power to scrape away and collect the lubricant of the tip of the blade, which reduces the lubricant amount on the low dot percentage part on the image carrying member and thereby handles the problem that wear of the cleaning blade shortens life thereof.

In the technique described in Japanese Patent Application Publication No. 2014-142472, even when an image having a high overall coverage is continuously printed, and thereby the lubricant amount on the low dot percentage part on the image carrying member increases, the developer supply amount for a patch is unchanged. Hence, the amount of the toner particles and the external additive accumulating at the tip of the cleaning blade is insufficient, which cannot reduce the lubricant amount on the low dot percentage part on the image carrying member and cannot prevent wear of the cleaning blade from progressing. However, if, then, the developer supply amount for a patch is set at a value which can reduce the lubricant amount on the low dot percentage part when an image having a high overall coverage is continuously printed, the developer supply amount is too much when an image having a low overall coverage is printed, which increases the developer consumption amount.

BRIEF SUMMARY OF THE INVENTION

Objects of the present invention include providing an image forming apparatus, an image forming method and a storage medium each of which can more certainly prevent wear of a clearing unit without increasing the developer consumption amount.

In order to achieve at least one of the objects, according to an aspect of the present invention, there is provided an image forming apparatus including: an image carrying member; a developing device which develops an electrostatic latent image formed on the image carrying member with a developer containing a toner and a lubricant; a cleaning unit which cleans the image carrying member by pressing in contact with the image carrying member; and a hardware processor which obtains lubricant amount information on a lubricant amount in the developing device, obtains, with respect to each of the sections formed by dividing a surface of the image carrying member in a rotating shaft direction of the image carrying member, a partial coverage from electrostatic latent image writing information for a predetermined period about the section, sets, for a section having the partial coverage of a predetermined value or less among the sections, a developer supply amount for a patch to be formed outside an image forming region on the image carrying member, based on the lubricant amount information, and causes the developing device to supply the set developer supply amount of the developer so that the patch is formed.

Preferably, in the image forming apparatus, the hardware processor obtains, as the lubricant amount information, an overall coverage which is a sum of the partial coverages of the respective sections, and makes the developer supply amount larger as the overall coverage is higher.

Preferably, in the image forming apparatus, the hardware processor sets, for the section having the partial coverage of the predetermined value or less, the developer supply amount based on the overall coverage and the partial coverage of the section.

Preferably, in the image forming apparatus, the hardware processor makes the developer supply amount smaller as the partial coverage is higher.

Preferably, in the image forming apparatus, the hardware processor changes at least one of a length of the patch in a rotation direction of the image carrying member, a dot pattern of the patch, an exposure amount, a developing bias, a number of the patch to be formed and a frequency of the patch so as to cause the developing device to supply the set developer supply amount of the developer.

Preferably, the image forming apparatus further includes a transfer device which transfers a toner image on the image carrying member formed by the developing device performing the development, wherein the cleaning unit cleans the image carrying member after the transfer device performs the transfer, and the hardware processor controls a transfer condition of the transfer device such that a developer remaining percentage of the patch after the patch passes through the transfer device is larger than a developer remaining percentage of the toner image excluding the patch after the toner image excluding the patch is transferred to paper.

Preferably, the image forming apparatus further includes a pre-cleaning unit which is disposed between the transfer device and the cleaning unit in a rotation direction of the image carrying member and cleans the image carrying member, wherein the cleaning unit cleans the image carrying member after the pre-cleaning unit cleans the image carrying member, and the hardware processor controls a cleaning condition of the pre-cleaning unit such that the developer remaining percentage of the patch after the patch passes through the pre-cleaning unit is larger than the developer remaining percentage of the toner image excluding the patch after the toner image excluding the patch is cleaned by the pre-cleaning unit.

Preferably, in the image forming apparatus, the pre-cleaning unit is a rotatable member which cleans the image carrying member by being pressed on the surface of the image carrying member, and the hardware processor controls the cleaning condition of the pre-cleaning unit by changing at least one of a rotation speed of the pre-cleaning unit, a bias to the pre-cleaning unit and a press amount of the pre-cleaning unit to the image carrying member.

Preferably, in the image forming apparatus, the patch is formed between one of the image forming region and another of the image forming region on the image carrying member with respect to the section having the partial coverage of the predetermined value or less.

Preferably, in the image forming apparatus, the hardware processor obtains the partial coverage from at least one of the electrostatic latent image writing information for the predetermined period in a past and the electrostatic latent image writing information for the predetermined period in a future based on a reserved job.

BRIEF DESCRIPTION OF THE SEVERAL VIEWS OF THE DRAWING

The present invention is fully understood from the detailed description given hereinafter and the accompanying drawings, which are given by way of illustration only and thus are not intended to limit the present invention, wherein.

DETAILED DESCRIPTION OF THE INVENTION

Hereinafter, an embodiment for carrying out the present invention is described with reference to the drawings. A variety of limitations which are technically preferable for carrying out the present invention are put on the embodiment as described below. However, the scope of the present invention is not limited to the embodiment or illustrated examples.

Figure 1:
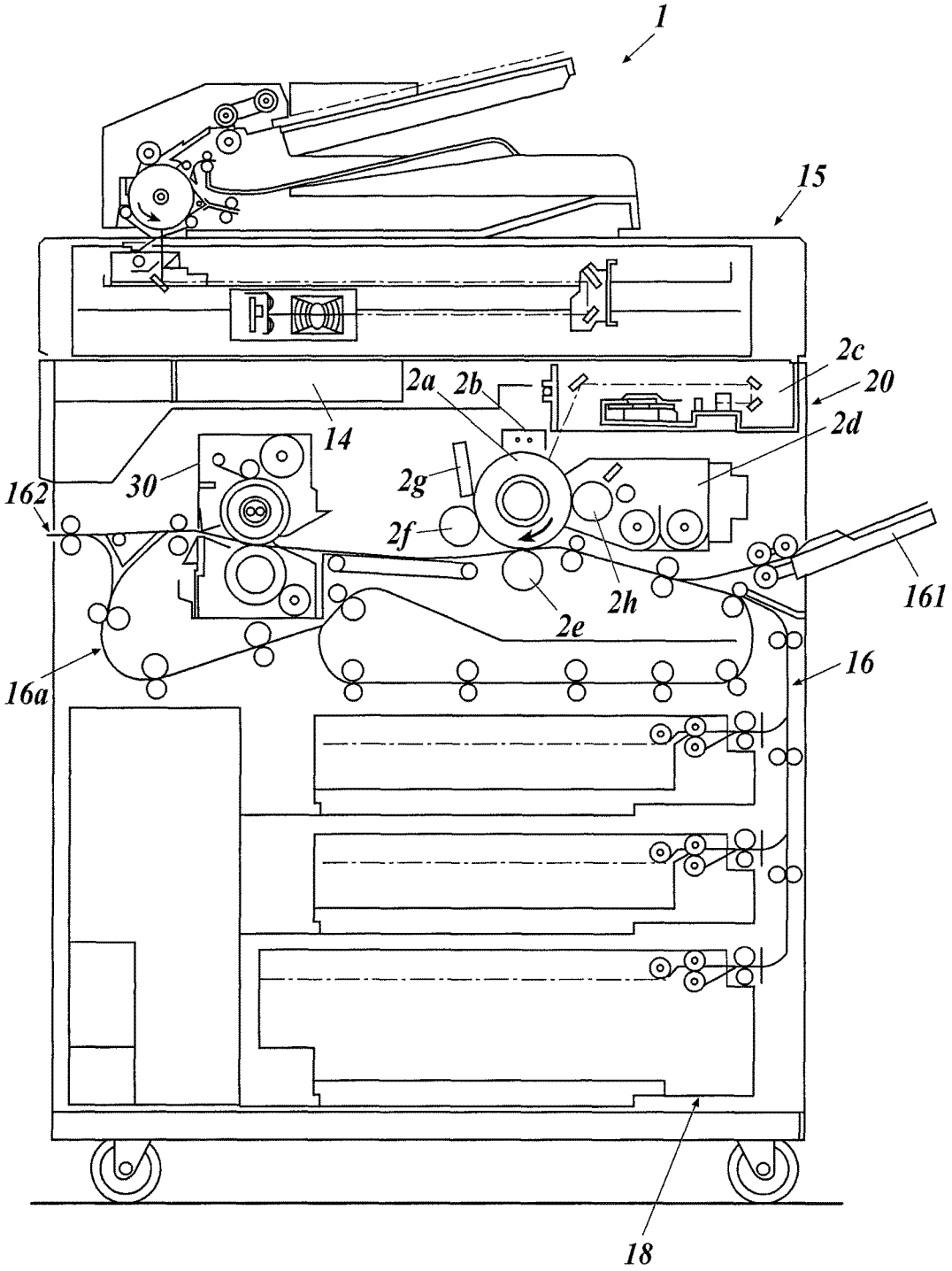
FIG. 1 is a schematic view showing an image forming apparatus according to an embodiment of the present invention.
Figure 2:
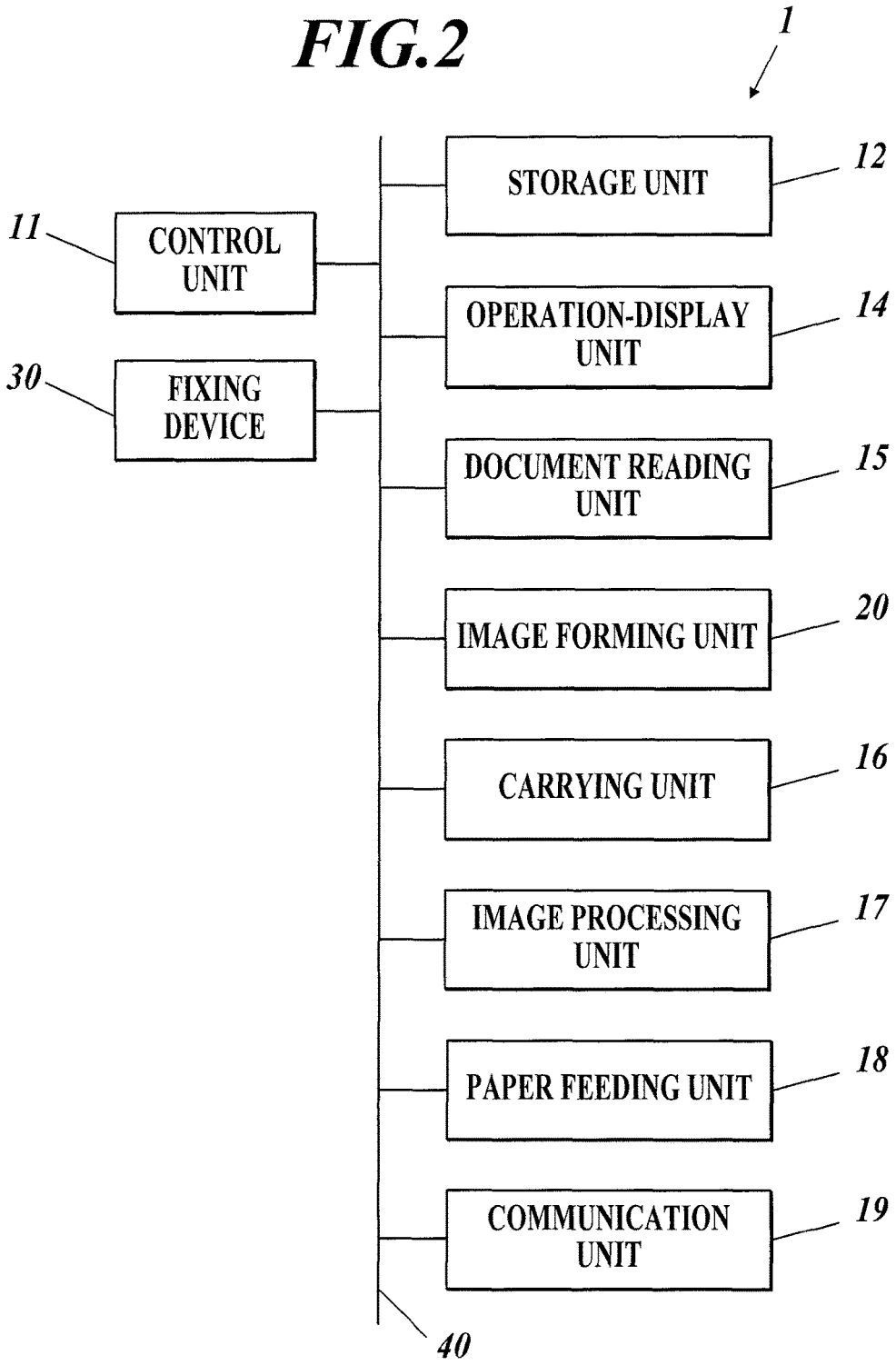
FIG. 2 is a block diagram showing the functional configuration of the image forming apparatus.

FIG. 1 shows the overall configuration of an image forming apparatus 1 according to an embodiment of the present invention. FIG. 2 is a block diagram showing the functional configuration of the image forming apparatus 1.

The image forming apparatus 1 is an image forming apparatus, such as a multifunction peripheral, which forms images on sheets of paper. As shown in FIG. 1, the image forming apparatus 1 includes an operation-display unit 14, a document reading unit 15, a carrying unit 16, a paper feeding unit 18, an image forming unit 20 and a fixing device 30.

The operation-display unit 14 is disposed in the upper part of the image forming apparatus 1 as a user interface. The operation-display unit 14 generates operation signals corresponding to user operations and outputs the signals to a control unit 11 (a hardware processor) (FIG. 2). As the operation-display unit 14, a keypad, a touch panel or the like can be used. The operation-display unit 14 has a display screen which displays an operation screen or the like in response to a command of the control unit 11. As the display screen, an LCD (Liquid Crystal Display), an OELD (Organic Electro Luminescence Display) or the like can be used.

The document reading unit 15 is a scanner or the like provided for copying, and reads the surface of each document (original) set on a document placement table and generates a bitmap original image having color values of R (red), G (green) and B (blue) for each pixel in response to a command of the control unit 11. The original image having color values of R, G and B generated by the document reading unit 15 is color-converted to an original image having color values of C, M, Y and K by a not-shown color conversion unit, and then stored in a storage unit 12 (FIG. 2).

The carrying unit 16 is constituted of a carrying roller and so forth, and carries paper fed from the paper feeding unit 18 or a manual feed tray 161 to the image forming unit 20 and the fixing device 30 and ejects the paper having been subjected to image forming and fixing to a paper ejecting unit 162. The carrying unit 16 has a reverse unit 16*a* which reverses the paper carried from the fixing device 30, and carries the reversed paper to the image forming unit 20 again.

The paper feeding unit 18 has a plurality of paper feed trays and feeds a sheet of paper to the image forming unit 20 in response to a command of the control unit 11. In each paper feed tray, sheets of paper of a predetermined paper type and size are housed.

The image forming unit 20 forms, in response to a command of the control unit 11, an image on a sheet of paper based on the original image image-processed by an image processing unit 17 (FIG. 2).

The image forming unit 20 includes: a drum-shaped photoreceptor 2*a* as an image carrying member which is driven to rotate in an arrow direction shown in FIG. 1; a charging device 2*b* which charges the surface of the photoreceptor 2*a* to be uniform electric potential with a charger or the like; an exposure device 2*c* which exposes the surface of the photoreceptor 2*a* charged by the charging device 2*b* with a laser or the like so as to form an electrostatic latent image; a developing device 2*d* which visualizes the electrostatic latent image formed by the exposure device 2*c* with a developer containing a toner; a transfer device 2*e* which transfers, to a sheet of paper, a toner image formed on the photoreceptor 2*a* by the developing device 2*d* applying a voltage having a polarity opposite to that of the toner; a pre-cleaning unit 2*f* which cleans the photoreceptor 2*a* having passed through the transfer device 2*e*; and a cleaning unit 2*g* which cleans the photoreceptor 2*a* having passed through the pre-cleaning unit 2*f*.

As the photoreceptor 2*a*, for example, an organic photoreceptor composed of a drum-shaped metal base and a photosensitive layer made of a resin containing an organic photoconductor formed on the outer circumferential surface of the metal base is used. Examples of the resin constituting the photosensitive layer include polycarbonate resin, silicone resin, polystyrene resin, acrylic resin, methacrylic resin, epoxy resin, polyurethane resin, polyvinyl chloride resin, and melamine resin.

The developing device 2*d* includes a developing sleeve 2*h* disposed to face the photoreceptor 2*a* via a development region. To this developing sleeve 2*h*, for example, (i) a DC developing bias having the same polarity as the charging polarity of the charging device 2*b* or (ii) a developing bias composed of an AC voltage and a DC voltage having the same polarity as the charging polarity of the charging device 2*b* superposed on the AC voltage is applied. This performs reversal development to make the toner adhere to the electrostatic latent image formed by the exposure device 2*c*. The toner image formed on the photoreceptor 2*a* by the developing device 2*d* is carried to a transfer region formed by the photoreceptor 2*a* and the transfer device 2*e*.

In the developing device 2*d*, a developer is housed. The developer is supplied from the outside of the developing device 2*d* into the developing device 2*d* according to the developer supply amount of the developer from the developing device 2*d* to the photoreceptor 2*a*. The developer housed in the developing device 2*d* contains at least a toner and a lubricant.

The toner contained in the developer is not particularly limited, and any well-known toner generally used can be used. For example, one which is composed of: toner particles made of a binder resin containing a colorant optionally with a charge control agent, a releasing agent and/or the like; and an external additive (s) added to the toner particles can be used. The average particle size of the toner particles is not particularly limited, but preferably about 3 to 15 μm, for example.

The lubricant contained in the developer is not particularly limited as long as it can reduce adhesion of the toner to the image carrying member. Examples thereof include fatty acid metal salt, silicone oil, and fluorine-based resin. These may be used alone, or two or more types thereof may be mixed to use. As the lubricant, fatty acid metal salt is particularly preferable. As the fatty acid component of the fatty acid metal salt, straight-chain hydrocarbon is preferable, for example. Preferable examples thereof include myristic acid, palmitic acid, stearic acid, and oleic acid. Of these, stearic acid is far preferable. Examples of the metal component of the fatty acid metal salt include lithium, magnesium, calcium, strontium, zinc, cadmium, aluminum, cerium, titanium, and iron. Of these, zinc stearate, magnesium stearate, aluminum stearate, iron stearate and so forth are preferable, and in particular, zinc stearate is the most preferable.

The developer used in the present invention may further contain a carrier. The carrier is not particularly limited, and any well-known carrier generally used, such as a binder-type carrier or a coating-type carrier, can be used. The average particle size of the carrier particles is not particularly limited, but preferably about 15 to 100 μm, for example. In the case where the developer contains a carrier, the carrier is heled by the developing sleeve 2*h* and returns into the developing device 2*d*. Hence, the developer supply amount in the present invention does not include the amount of the carrier.

The pre-cleaning unit 2*f* is a brush roller which contacts the surface of the photoreceptor 2*a*, is disposed to face the photoreceptor 2*a* and is rotatable with a not-shown drive device. The pre-cleaning unit 2*f* is composed of a rotatable member and conductive fibers having elasticity implanted in the surface of the rotatable member. The pre-cleaning unit 2*f* is connected to a not-shown predetermined power source, and a current having a polarity opposite to that of the toner adhering to the photoreceptor 2*a* is applied to the pre-cleaning unit 2*f*. This makes it possible to electrically catch and collect the developer not transferred onto paper at the transfer region and remaining on the photoreceptor 2*a* with the conductive fibers of the pre-cleaning unit 2*f*. Further, the pre-cleaning unit 2*f* is configured to contact or separate from the photoreceptor 2*a*, and moves to a place where the pre-cleaning unit 2*f* contacts the photoreceptor 2*a* or a place where the pre-cleaning unit 2*f* separates from the photoreceptor 2*a* in response to a command of the control unit 11.

The cleaning unit 2*g* is a flat cleaning blade made of an elastic member and disposed such that the tip part thereof abuts the photoreceptor 2*a*. Because the developer housed in the developing device 2*d* of the image forming apparatus 1 contains the toner and the lubricant, the developer containing the toner and the lubricant accumulating at the tip part of the cleaning unit 2*g* reduces coefficient of friction of the cleaning unit 2*g*, and the cleaning unit 2*g* rubs (polishes) the photoreceptor 2*a*. The cleaning unit 2*g* scraps away the developer remaining on the photoreceptor 2*a* so as to collect the developer by rubbing the surface of the photoreceptor 2*a*. The developer scraped away from the photoreceptor 2*a* by the cleaning unit 2*g* is collected from a not-shown screw or the like. The photoreceptor 2*a* from which the developer has been collected by the cleaning unit 2*g* is charged again by the charging device 2*b*, and the next electrostatic latent image and a toner image thereof are formed on the photoreceptor 2*a*. This process is repeated.

At the time of image forming, the image forming unit 20 thus configured: applies a voltage to the photoreceptor 2*a* with the charging device 2*b*, thereby charging the photoreceptor 2*a*; and then scans the photoreceptor 2*a* with a beam which the exposure device 2*c* emits based on the original image, thereby forming an electrostatic latent image. The image forming unit 20 supplies the developer onto the photoreceptor 2*a* with the developing device 2*d*, thereby developing the electrostatic latent image on the photoreceptor 2*a* and accordingly forming a toner image on the photoreceptor 2*a*. After forming the toner image on the photoreceptor 2*a*, the image forming unit 20 transfers the toner image on the photoreceptor 2*a* to a sheet of paper with the transfer device 2*e*. After transferring the toner image to the sheet of paper, the image forming unit 20 removes the developer remaining on the photoreceptor 2*a* with the pre-cleaning unit 2*f* and the cleaning unit 2*g*. In addition, the image forming unit 20 feeds the sheet of paper with the paper feeding unit 18, and carries, to the fixing device 30, the sheet having the toner image transferred thereto by the transfer device 2*e*.

The fixing device 30 fixes, to the sheet of paper, the toner image formed by the image forming unit 20, thereby forming an image on the sheet, in response to a command of the control unit 11. That is, the fixing device 30 applies heat and pressure to the sheet having the toner image formed by the image forming unit 20. In the case where images are formed on both sides of a sheet of paper, a sheet having an image fixed by the fixing device 30 is reversed by the reverse unit 16*a* and then carried to the transfer device 2*e* again.

As shown in FIG. 2, the image forming apparatus 1 includes the control unit 11, the storage unit 12, the operation-display unit 14, the document reading unit 15, the carrying unit 16, the image processing unit 17, the paper feeding unit 18, the image forming unit 20, the fixing device 30 and a communication unit 19. These units of the image forming apparatus 1 are connected with one another via a bus 40.

The control unit 11 includes a CPU (Central Processing Unit), a RAM (Random Access Memory) and a ROM (Read Only Memory), and controls the units or the like of the image forming apparatus 1. The ROM is a storage unit where various programs and various data are stored. The control unit 11 reads the various programs from the ROM, appropriately opens the programs on the RAM, and performs various processes with the CPU working together with the opened programs. For example, the control unit 11 causes the image processing unit 17 to perform image processing on the bitmap original image generated by the document reading unit 15 or received via the communication unit 19 and stored in the storage unit 12, and causes the image forming unit 20 to form an image on a sheet of paper based on the image-processed original image data.

The storage unit 12 is an image memory constituted of a DRAM (Dynamic Random Access Memory) or the like and temporarily storing various data, such as image data to be subjected to various types of image processing. The storage unit 12 may have an HDD (Hard Disk Drive) or the like so that various data can be written therein and read therefrom.

The image processing unit 17 performs necessary image processing on the image data stored in the storage unit 12, the image data obtained by the document reading unit 15 reading an image from each document (original) and the image data input from external apparatuses via the communication unit 19, and outputs the image-processed image data to the image forming unit 20. Examples of the image processing include gradation processing, halftone processing and color conversion. The gradation processing is a process of converting (correcting) gradation values of pixels of image data into gradation values with which density characteristics of an image formed on a sheet of paper match target density characteristics. The halftone processing is exemplified by error diffusion and screening employing ordered dithering.

The communication unit 19 is constituted of a network card or the like and connected to a network, such as a LAN (Local Area Network). The communication unit 19 communicates with external apparatuses on the network, such as a user terminal exemplified by a PC (Personal Computer) and a server. The communication unit 19 receives image data for images to be formed from the external apparatuses via the network.

Next, an action of the image forming apparatus 1 is described.

In the present invention, the control unit 11 (i) obtains, with respect to each of the sections formed by dividing the surface of the photoreceptor 2*a* in the rotating shaft direction of the photoreceptor 2*a*, the partial coverage from electrostatic latent image writing information for a predetermined period about the section, (ii) sets, for a section(s) having the partial coverage of a predetermined value or less among the sections, the developer supply amount for a patch to be formed outside an image forming region on the photoreceptor 2*a*, based on lubricant amount information and (iii)

causes the developing device 2*d* to supply the set developer supply amount of the developer so that the patch is formed.

The image forming region(s) is, of an electrostatic latent image writing region on the photoreceptor 2*a*, a region where a user's desired image is formed, and a no-image forming region(s) is, of the electrostatic latent image writing region on the photoreceptor 2*a*, a region other than the image forming region (s).

Figure 6:
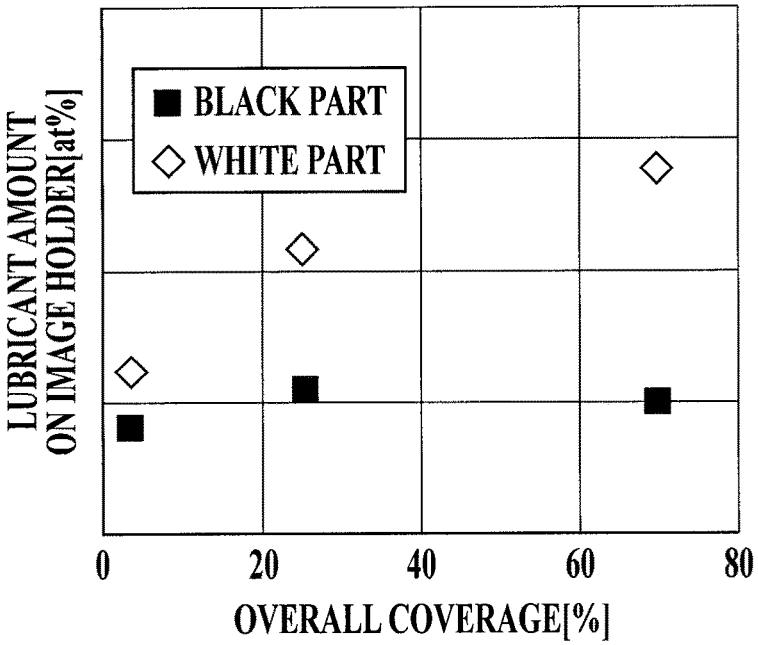
FIG. 6 is a graph showing the lubricant amount on each of the image part (black part) and the background part (white part) on an image carrying member with respect to the overall coverage of each formed image.
Figure 7:
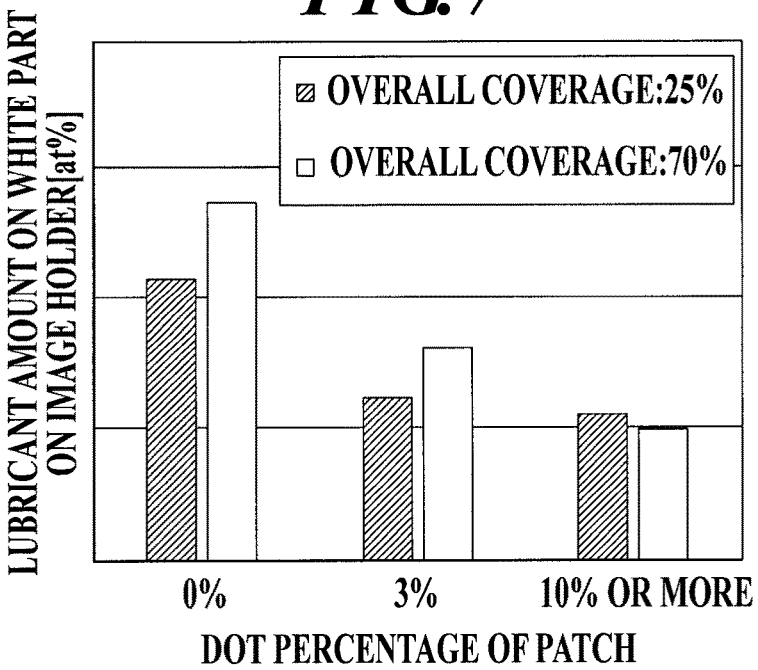
FIG. 7 is a graph showing the lubricant amount on the background part (white part) on the image carrying member with respect to the dot percentage of each formed patch.

The present inventors have zealously studied and obtained the results shown in FIG. 6 and FIG. 7. FIG. 6 is a graph showing the lubricant amount (at %) on each of the image part (black part) and the background part (white part) in the image forming region on the image carrying member with respect to the dot percentage (overall coverage) (%) of each formed image. FIG. 7 is a graph showing the lubricant amount (at %) on the background part (white part) in the image forming region on the image carrying member with respect to the dot percentage of each formed patch.

As shown in FIG. 6, it has been found out that when the white part after an image having a high overall coverage is continuously printed is compared with the white part after an image having a low overall coverage is continuously printed, although the white parts have the same dot percentage (0%), the lubricant amount on the white part in the former case is larger. From this, it is assumed that when an image having a high overall coverage is printed, the lubricant amount on the low dot percentage part on the image carrying member increases.

In the toner externally-added system, when an image having a low overall coverage is continuously printed, although the lubricant is consumed at the background part (white part), the toner is not consumed because the image part (black part) is small, and therefore the developer is not newly supplied into the developing device. Because the lubricant is supplied into the developing device together with the toner as the developer, if such a situation continues, the lubricant amount in the developing device decreases. To the contrary, when an image having a high overall coverage is continuously printed, the toner is consumed because the image part (black part) is large, and therefore the developer is newly supplied into the developing device one after another, and the lubricant amount in the developing device increases. When the lubricant amount in the developing device increases, the lubricant amount supplied to the white part on the image carrying member also increases. In addition, as described above, the lubricant scraping-away power of the cleaning blade is low at the low dot percentage part. From these, it is assumed that when an image having a high overall coverage is continuously printed, the lubricant amount on the low dot percentage part on the image carrying member increases.

Further, as it is shown in FIG. 7, even under the condition that an image having a high overall coverage is continuously printed, and thereby the lubricant amount on the low dot percentage part increases, the lubricant amount on the low dot percentage part can be reduced by increasing the dot percentage of a patch so as to increase the developer supply amount for a patch, thereby increasing the supply amount of the toner particles and the external additive to the cleaning blade so as to increase the lubricant scraping-away power of the cleaning blade at the low dot percentage part.

As described above, increase in the lubricant amount on the low dot percentage part of an image on the photoreceptor 2*a* occurs by increase in the lubricant amount in the developing device 2*d* and supply of a large amount of the lubricant to the background part of the image. Further, increase in the lubricant amount in the developing device 2*d* occurs by increase in the developer consumption amount due to an image having a high overall coverage printed and frequent supply of the developer into the developing device 2*d*. Therefore, the lubricant amount in the developing device 2*d* can be estimated based on the overall coverage of a formed image. In the embodiment, control on the developer supply amount for a patch based on the overall coverage as the lubricant amount information makes it possible to supply a large amount of the developer to the cleaning unit 2*g*, which can prevent wear of the cleaning unit 2*g*.

Figure 3:
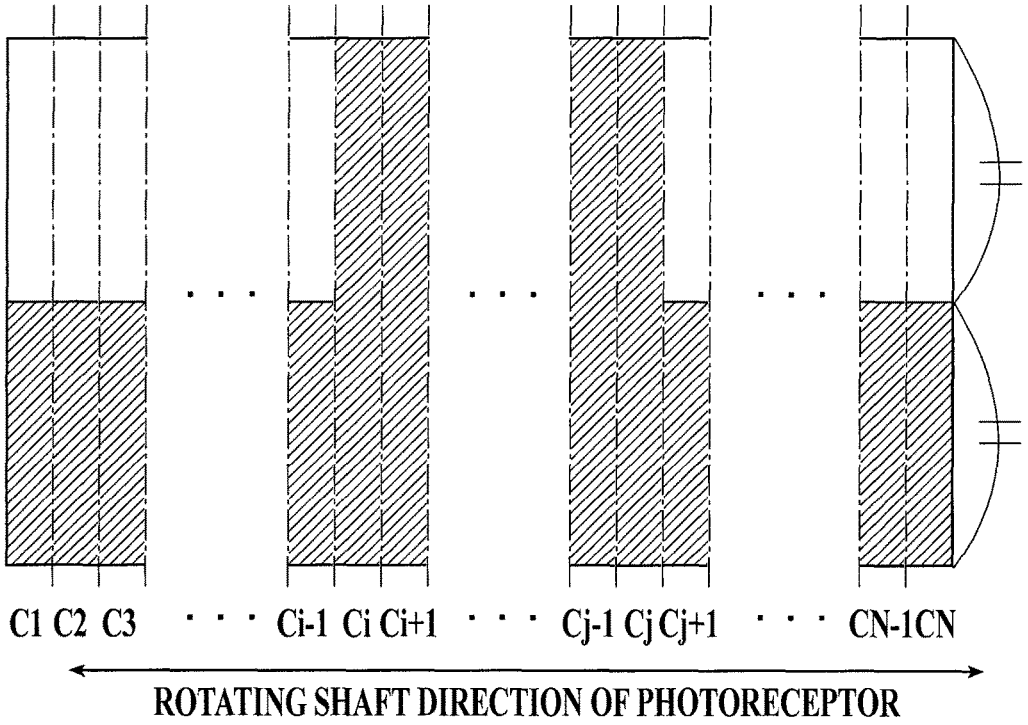
FIG. 3 is a schematic view showing the area of the image part in each of N sections into which an electrostatic latent image writing region of a photoreceptor is divided in its rotating shaft direction.

Here, a method for the control unit 11 to obtain the partial coverages is described with reference to FIG. 3. FIG. 3 shows an example of the dot percentage (partial coverage) of each of N sections into which the electrostatic latent image writing region on the photoreceptor 2*a* is divided in the rotating shaft direction. In FIG. 3, the shadow parts indicate the developer adhesion areas in the respective sections.

As shown in FIG. 3, the control unit 11 obtains, with respect to each of N sections formed by dividing the electrostatic latent image writing region on the surface of the photoreceptor 2*a* in the rotating shaft direction, the partial coverage indicating the percentage of the developer adhesion area in the electrostatic latent image writing region in the section. More specifically, the control unit 11 calculates, with respect to each of the sections, the partial coverage from the electrostatic latent image writing information about the section. For example, in the case shown in FIG. 3, the partial coverages Ci to Cj of the $i^{th}$ to $j^{th}$ sections are 100%, and the partial coverages of the other sections are 50%. Thus, the control unit 11 may calculate, with respect to each of the sections, the partial coverage from the percentage of the image part in the image forming region in the section. The partial coverage of each section is calculated from at least one of the electrostatic latent image writing information for a predetermined period in the past about the section (i.e., information on electrostatic latent images written/formed in the section on the photoreceptor 2*a* for a predetermined period in the past) and the electrostatic latent image writing information for a predetermined period in the future about the section (i.e., information on electrostatic latent images to be written/formed in the section on the photoreceptor 2*a* for a predetermined period in the future) based on a reserved job(s).

It is preferable that the partial coverage of each section be obtained from the entire electrostatic latent image writing region, which includes the no-image forming region, in the section. This is because, in the no-image forming region between the image forming regions, an image may be formed in various print modes in order to maintain image quality, and calculation of the partial coverage of each section from the entire electrostatic latent image writing region, which includes the no-image forming region, in the section makes it possible to obtain the partial coverage which is more highly accurate. In this case, the partial coverage is calculated by counting (taking) the image formed in the no-image forming region as the image part.

In the embodiment, the control unit 11 shown in FIG. 2 functions as a lubricant amount information obtaining unit which obtains information on the lubricant amount in the developing device 2*d* (i.e., the lubricant amount information).

In the embodiment, the control unit 11 obtains, as the lubricant mount information, the overall coverage which is the sum of the partial coverages of the respective sections into which the electrostatic latent image writing region of the photoreceptor 2*s* is divided in the rotating shaft direction. In the case shown in FIG. 3, the overall coverage Call is the sum of the partial coverages C1 to CN. It is preferable that the overall coverage be also calculated from the entire electrostatic latent image writing region, which includes the no-image forming region, for the above reason.

Further, the control unit 11 sets, for a section(s) having the partial coverage of a predetermined value or less among the sections into which the electrostatic latent image writing region on the surface of the photoreceptor 2*s* is divided in the rotating shaft direction, the developer supply amount for a patch based on the calculated overall coverage and partial coverage of the section. The control unit 11 makes the developer supply amount larger as the overall coverage is higher and makes the developer supply amount smaller as the partial coverage of the section is higher. This makes it possible to more certainly reduce the lubricant amount on the photoreceptor 2*a* and thereby prevent wear of the cleaning unit 2*g*, and also makes it possible to more certainly reduce the developer consumption amount. Then, while a job is being performed, the set developer supply amount of the developer is supplied to the section having the partial coverage of the predetermined value or less, whereby the patch is formed in the no-image forming region between the image forming regions on the photoreceptor 2*a*. Patch forming in parallel with job execution enables efficient image forming without job suspension. The control unit 11 performs the above-described patch forming every predetermined period after starting a job. This predetermined period is set based on, for example, the accumulated number of rotations of the photoreceptor 2*a*, operating time of the developing device 2*d* and/or the number of sheets having been subjected to printing.

The control unit 11 may perform patch forming in a patch print mode, thereby performing patch forming after suspending the currently performed job or while no job is being performed. Examples of the time no job is being performed include: a start sequence from the start of a job until a toner image is transferred to the first sheet of paper; an end sequence from the end of a job until the photoreceptor 2*a* and the developing device 2*d* stop operating; during various print modes, such as an image stabilization mode, and a waiting mode; and timings before or after the modes.

Here, a method for supplying the set developer supply amount of the developer onto the photoreceptor 2*a* is described in detail with reference to FIGS. 4A to 4F. FIGS. 4A to 4F show examples of the patch to be formed on the photoreceptor 2*a*.

The control unit 11 changes the developer amount for the area of a patch (density of a patch), the area of a patch, the (total) number of patches to be formed and/or the like so as to cause the developing device 2*d* to supply the set developer supply amount of the developer onto the photoreceptor 2*a*. The control unit 11 may change any of these. However, in order to reduce the developer consumption amount and efficiently form a patch(es) between the image forming regions, it is preferable that the area of each patch be small.

Figure 4A:
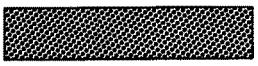
FIGS. 4A to 4F are schematic views showing examples of the patch.
Figure 4B:
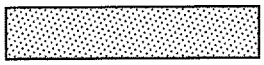

The density of a patch can be changed by controlling a development condition (the developing bias of the developing sleeve 2*h*, the exposure amount of the exposure device 2*c*, etc.). That is, the density of a patch can be changed by controlling the development condition, thereby changing potential difference between the developing sleeve 2*h* and the photoreceptor 2*a* and accordingly controlling the developer amount moving to the photoreceptor 2*a* from the developing sleeve 2*h*. When the developing bias of the developing sleeve 2*h* increases or the exposure amount of the exposure device 2*c* increases, the potential difference increases, and as shown in FIG. 4A as an example, the density of a patch can be high (dark). On the other hand, when the developing bias of the developing sleeve 2*h* decreases or the exposure amount of the exposure device 2*c* decreases, the potential difference decreases, and as shown in FIG. 4B as an example, the density of a patch can be low (light).

Figure 4C:
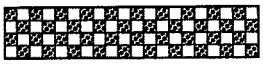

The area of a patch can be changed by changing a pattern to be exposed by the exposure device 2*c*, without changing the development condition. For example, the area of a patch shown in FIG. 4A is reduced to that shown in FIG. 4C by changing the dot pattern of a patch as shown in FIG. 4C.

Figure 4D:
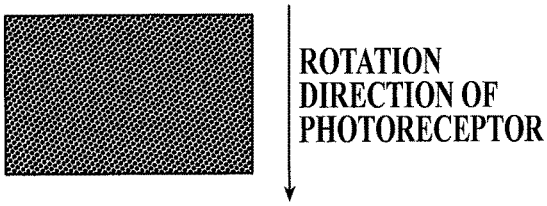

The area of a patch can also be changed by changing the length of a patch in the rotation direction of the photoreceptor 2*a*, without changing the development condition. For example, the area of a patch shown in FIG. 4A is increased to that shown in FIG. 4D by changing the length of a patch in the rotation direction of the photoreceptor 2*a* as shown in FIG. 4D.

The above method for changing the area of a patch makes it possible to more stably perform patch forming in parallel with job execution than the method which includes changing the development condition, because the former makes it possible to form a patch(es) under the same condition as that for forming an image(s) in the image forming region.

Figure 4E:
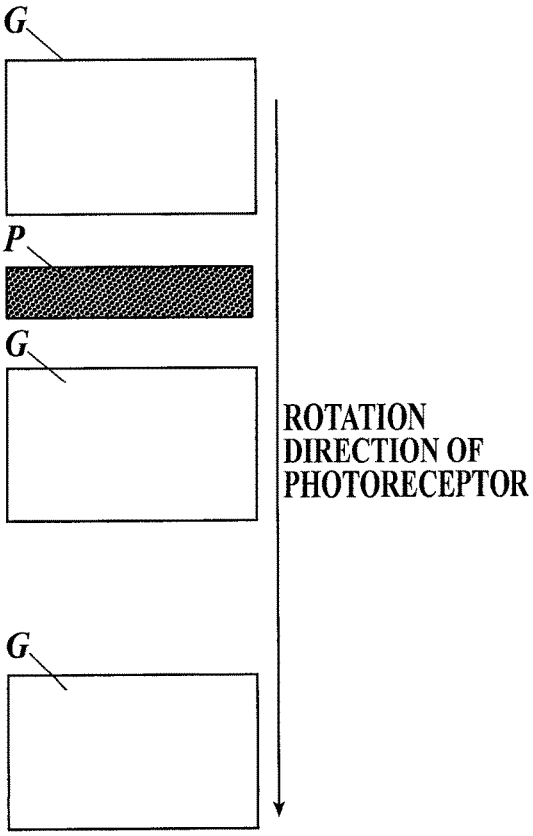
Figure 4F:
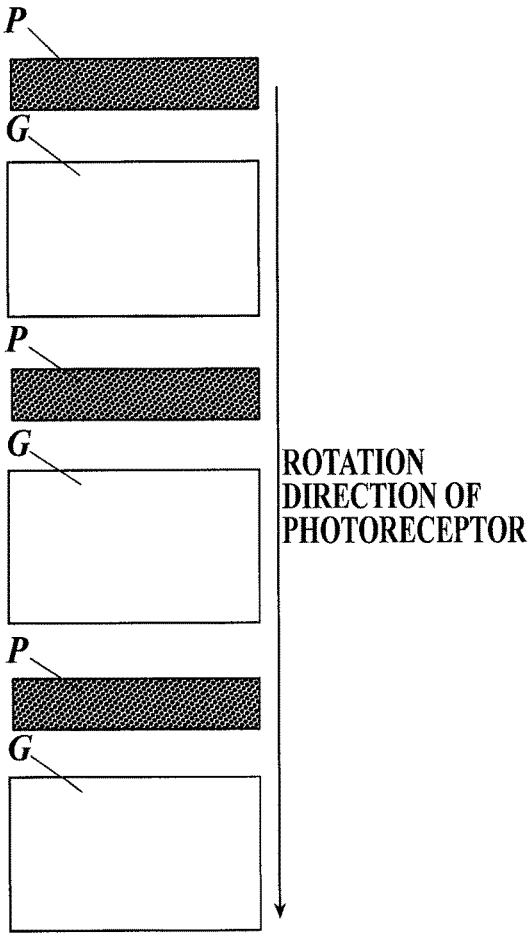

The number of patches to be formed can be changed by changing the frequency of patches P, which are formed between image forming regions G, as shown in FIGS. 4E and 4F as an example, without changing the development condition. This method can further reduce the developer amount on the photoreceptor 2*a* reaching the cleaning unit 2*g* at once and more certainly prevent occurrence of poor cleaning, which is caused by a temporary excess of the developer amount accumulating at the tip part of the cleaning unit 2*g*, as compared with the above method for changing the area of a patch. Further, this method can make the area of each patch small and hence is suitable for forming patches between the image forming regions. The number of patches to be formed may be changed by simply changing the number of patches P to be formed between the image forming regions G.

The control unit 11 shown in FIG. 2 makes the developer amount to be collected at the units or the like which are disposed from where a patch (es) is formed on the photoreceptor 2*a* to where the patch reaches the cleaning unit 2*g* smaller, in order to make a larger amount of the developer on the patch formed on the photoreceptor 2*a* more certainly reach the cleaning unit 2*g*.

That is, the control unit 11 controls a transfer condition of the transfer device 2*e* such that the developer remaining percentage of a patch after the patch passes through the transfer device 2*e* is larger than the developer remaining percentage of a toner image of not a patch but another image after the toner image is transferred to paper, thereby reducing transfer efficiency of the transfer device 2*e*.

Movement of the developer to paper can be prevented electrostatically by making the transfer bias low or setting the transfer bias opposite to that of the time of image forming, for example. Further, adhesion of the developer to paper can be prevented mechanically by changing the press force on the paper and accordingly on the photoreceptor 2*a* or changing the speed difference between the photoreceptor 2*a* and the transfer device 2*e*.

Further, the control unit 11 controls a cleaning condition of the pre-cleaning unit 2*f* such that the developer remaining percentage of a patch after the patch passes through the pre-cleaning unit 2*f* is larger than the developer remaining percentage of a toner image of not a patch but another image after the toner image is cleaned by the pre-cleaning unit, thereby reducing developer collection efficiency of the pre-cleaning unit 2*f*.

This collection efficiency of the developer from the photoreceptor 2*a* can be reduced by applying a bias which repels the toner to the pre-cleaning unit 2*f*, changing the rotation speed of the pre-cleaning unit 2*f* or changing the press force (amount) of the pre-cleaning unit 2*f* to the photoreceptor 2*a*, for example.

The control unit 11 can more certainly let a larger amount of the developer on a patch (es) be supplied to the cleaning unit 2*g* and reduce the developer consumption amount by changing the transfer condition in a short time in time to the patch on the photoreceptor 2*a* passing through the transfer device 2*e* and/or changing the cleaning condition in a short time in time to the patch on the photoreceptor 2*a* passing through the pre-cleaning unit 2*f*.

If, as the patch print mode, patch forming is performed not in parallel with job execution, the transfer condition and the cleaning condition for patch forming may be set in advance and kept as they are during the period (patch print mode).

Here, an example of the patch forming process (patch forming) performed by the control unit 11 in the image forming apparatus 1 configured as described above is described with reference to FIG. 5.

Figure 5:
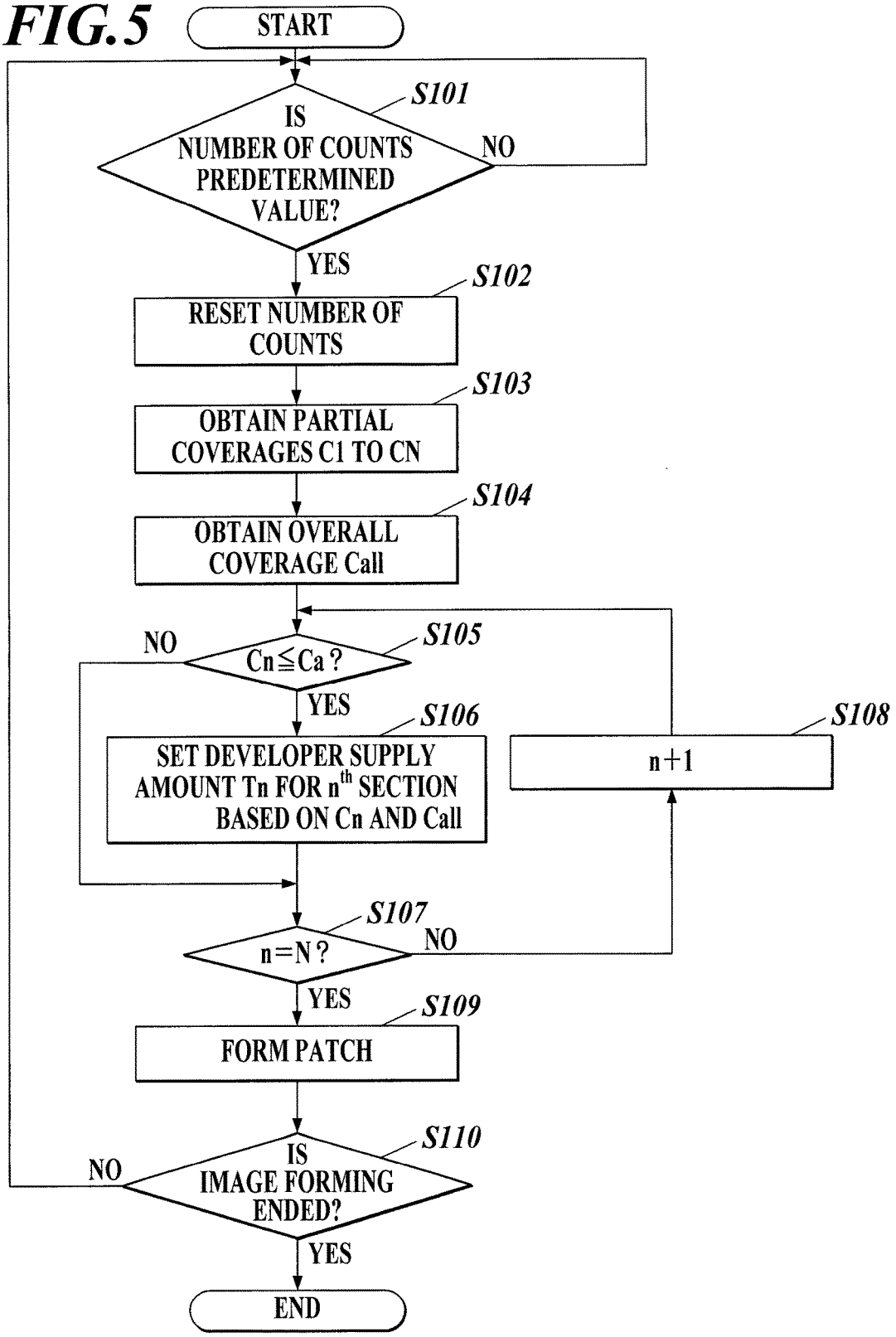
FIG. 5 is a flowchart showing an example of a patch forming process.

FIG. 5 is a flowchart showing an example of the patch forming process.

First, when starting the image forming process (image forming), the control unit 11 starts counting a predetermined parameter, and determines whether or not the number of counts of the parameter has reached a predetermined value set in advance (Step S101). Examples of the parameter include: the accumulated number of rotations of the photoreceptor 2*a*; operating time of the developing device 2*d*; and the number of sheets having been subjected to printing.

When determining that the number of counts thereof has not reached the predetermined value yet (Step S101; NO), the control unit 11 repeats Step S101.

On the other hand, when determining that the number of counts thereof has reached the predetermined value (Step S101; YES), the control unit 11 resets the number of counts (Step S102) and obtains the partial coverages C1 to CN with respect to the respective N sections into which the electrostatic latent image writing region on the photoreceptor 2*a* is divided in the rotating shaft direction, (Step S103). The control unit 11 calculates the partial coverages C1 to CN based on the electrostatic latent image writing information for a predetermined period in the past about the respective N sections and successively stores the calculated partial coverages C1 to CN in the storage unit 12.

Next, the control unit 11 obtains the overall coverage Call by adding up the obtained partial coverages C1 to CN (Step S104). The control unit 11 stores the obtained overall coverage Call in the storage unit 12.

Next, the control unit 11 determines, with respect to each of all the obtained partial coverages C1 to CN starting from the partial coverage C1, whether or not the partial coverage Cn (n is an integer of 1 to N) is equal to or less than a predetermined threshold value Ca, namely, determines whether or not the $n^{th}$ section is the low dot percentage part (Step S105). The predetermined threshold value Ca is set at 15% or less, preferably 5% or less. The larger the threshold value Ca is, the more certainly the lubricant amount can be reduced, whereas the smaller the threshold value Ca is, the more the developer consumption amount can be reduced. When the value of N, which is the number of sections, is large, the lubricant amount on the photoreceptor 2*a* can be reduced even if the threshold value Ca is small. Thus, the threshold value Ca can be and should be appropriately set according to the number of sections, N, and the configuration of the image forming apparatus 1.

When determining that the partial coverage Cn is equal to or less than the predetermined threshold value Ca (Step S105; YES), the control unit 11 determines that the $n^{th}$ section is the low dot percentage part and sets the developer supply amount Tn for the $n^{th}$ section based on the partial coverage Cn and the overall coverage Call (Step S106).

On the other hand, when determining that the partial coverage Cn is not equal to or less than the predetermined threshold value Ca (Step S105; NO), the control unit 11 moves to Step S107, skipping Step S106.

Next, the control unit 11 determines about n of the partial coverage Cn whether or not n=N (Step S107). When determining that n≠N (Step S107; NO), the control unit 11 adds 1 to n (Step S108) and returns to Step S105 because it means that not all the N sections have been subjected to the determination whether or not the $n^{th}$ section is the low dot percentage part. That is, the control unit 11 determines, with respect to each of all the N sections, whether or not the partial coverage Cn is equal to or less than the threshold value Ca.

On the other hand, when determining that n=N (Step S107; YES), the control unit 11 causes the developing device 2*d* to supply the developer supply amount (s) of the developer set at Step S106 to the section (s) on the photoreceptor 2*a*, the section being determined that the partial coverage Cn is equal to or less than the threshold value Ca at Step S105, so that the patch (es) is formed (Step S109) because it means that all the N sections have been subjected to the determination whether or not the $n^{th}$ section is the low dot percentage part.

Finally, the control unit 11 determines whether or not to end the image forming process (Step S110). When determining not to end the image forming process (Step S110; NO), the control unit 11 returns to Step S101.

On the other hand, when determining to end the image forming process (Step S110; YES), the control unit 11 ends the patch forming process.

Thus, the patch forming process is performed.

In the patch forming process shown in FIG. 5, during job execution, patch forming is started based on whether or not the number of counts of a parameter has reached a predetermined value. However, this is not a limit. That is, as long as patch forming can be started before the lubricant amount on the photoreceptor 2*a* becomes too much, it can be started based on any condition.

Further, in the patch forming process shown in FIG. 5, as the electrostatic latent image writing information used for calculation of the partial coverage Cn, reference is made to the electrostatic latent image writing information for a predetermined period in the past. However, this is not a limit. That is, as long as the period is sufficient to set the developer supply amount Tn fit for the actual states of the lubricant amount on the photoreceptor 2*a*, the developer amount accumulating at the tip part of the cleaning unit 2*g* and so forth, the period can be any. For example, the period may be a period for the photoreceptor 2*a* to make one rotation or a period for the photoreceptor 2*a* to make several hundred rotations. Further, the period may be a predetermined period in the future based on a reserved job(s).

As described above, according to the embodiment, the image forming apparatus 1 includes: the photoreceptor 2*a*; the developing device 2*d* which develops an electrostatic latent image formed on the photoreceptor 2*a* with a developer containing a toner and a lubricant; the cleaning unit 2*g* which cleans the photoreceptor 2*a* by pressing in contact with the photoreceptor 2*a*; and the control unit 11 which (i) obtains lubricant amount information on the lubricant amount in the developing device 2*d*, (ii) obtains, with respect to each of the sections formed by dividing the surface of the photoreceptor 2*a* in the rotating shaft direction of the photoreceptor 2*a*, a partial coverage from electrostatic latent image writing information for a predetermined period about the section, (iii) sets, for a section (s) having the partial coverage of a predetermined value or less among the sections, the developer supply amount for a patch to be formed outside an image forming region on the photoreceptor 2*a*, based on the lubricant amount information, and (iv) causes the developing device 2*d* to supply the set developer supply amount of the developer so that the patch is formed. Thus, the developer supply amount for a patch can be adjusted according to the lubricant amount in the developing device 2*d*. Hence, when the lubricant amount in the section having a low partial coverage on the photoreceptor 2*a* increases because the lubricant amount in the developing device 2*d* increases, a sufficient amount of the developer can be supplied to the section, whereby the lubricant can be more certainly scraped away and collected and accordingly the lubricant amount in the section can be reduced. Because the lubricant amount on the photoreceptor 2*a* can be reduced, close contact between the photoreceptor 2*a* and the cleaning unit 2*g* can be prevented, and accordingly wear of the cleaning unit 2*g* can be prevented. Therefore, wear of the cleaning unit 2*g* can be more certainly prevented without increasing the developer consumption amount.

Further, the control unit 11 (*i*) obtains, as the lubricant amount information, an overall coverage which is the sum of the partial coverages of the respective sections, and (ii) makes the developer supply amount larger as the overall coverage is higher. Thus, the lubricant amount information can be obtained with a simple method and a simple configuration. Further, wear of the cleaning unit 2*g* can be more certainly prevented without increasing the developer consumption amount.

Further, the control unit 11 sets, for the section having the partial coverage of the predetermined value or less, the developer supply amount based on the overall coverage and the partial coverage of the section. Thus, the developer supply amount for a patch can be adjusted with higher accuracy.

Further, the control unit 11 makes the developer supply amount smaller as the partial coverage is higher. Thus, the developer consumption amount can be more certainly reduced.

Further, the control unit 11 changes at least one of the length of a patch in the rotation direction of the photoreceptor 2*a*, the dot pattern of a patch, the exposure amount, the developing bias, the number of patches to be formed and the frequency of patches so as to cause the developing device 2*d* to supply the set developer supply amount of the developer. Thus, the developer amount of a patch can be set with high accuracy. Hence, a more appropriate amount of the developer can be supplied to the cleaning unit 2*g*, and wear of the cleaning unit 2*g* can be more certainly prevented without increasing the developer consumption amount.

Further, the image forming apparatus 1 further includes the transfer device 2*e* which transfers a toner image on the photoreceptor 2*a* formed by the developing device 2*d* performing development, wherein the cleaning unit 2*g* cleans the photoreceptor 2*a* after the transfer device 2*e* performs transfer, and the control unit 11 controls the transfer condition of the transfer device 2*e* such that the developer remaining percentage of a patch after the patch passes through the transfer device 2*e* is larger than the developer remaining percentage of a toner image of not a patch but another image after the toner image is transferred to paper. Thus, a more appropriate amount of the developer can be supplied to the cleaning unit 2*g* without reducing the developer amount (or developer remaining percentage) of a patch. Hence, the developer consumption amount can be more certainly reduced.

Further, the image forming apparatus 1 further includes the pre-cleaning unit 2*f* which is disposed between the transfer device 2*e* and the cleaning unit 2*g* in the rotation direction of the photoreceptor 2*a* and cleans the photoreceptor 2*a*, wherein the cleaning unit 2*g* cleans the photoreceptor 2*a* after the pre-cleaning unit 2*f* cleans the photoreceptor 2*a*, and the control unit 11 controls the cleaning condition of the pre-cleaning unit 2*f* such that the developer remaining percentage of a patch after the patch passes through the pre-cleaning unit 2*f* is larger than the developer remaining percentage of a toner image of not a patch but another image after the toner image is cleaned by the pre-cleaning unit 2*f*. Thus, a more appropriate amount of the developer can be supplied to the cleaning unit 2*g* without reducing the developer amount (or developer remaining percentage) of a patch. Hence, the developer consumption amount can be more certainly reduced.

Further, the pre-cleaning unit 2*f* is a rotatable member which cleans the photoreceptor 2*a* by being pressed on the surface of the photoreceptor 2*a*, and the control unit 11 controls the cleaning condition of the pre-cleaning unit 2*f* by changing at least one of the rotation speed of the pre-cleaning unit 2*f*, the bias to the pre-cleaning unit 2*f* and the press amount of the pre-cleaning unit 2*f* to the photoreceptor 2*a*. Thus, the cleaning condition of the pre-cleaning unit 2*f* can be changed with a simple method and a simple configuration.

Further, a patch (es) is formed between image forming regions on the photoreceptor 2*a* with respect to the section having the partial coverage of the predetermined value or less. Thus, a patch (es) can be formed without postponing the image forming process.

The above embodiment is one of preferred examples of the image forming apparatus of the present invention, and hence the present invention is not limited thereto.

For example, in the above embodiment, the image forming unit 20 performs monochrome image forming, but may perform color image forming. In that case, a plurality of image forming units 20 for respective colors may be provided. Further, in the above embodiment, the image forming unit 20 transfers the toner image formed on the photoreceptor 2*a* to paper, but may transfer the toner image to an intermediate transfer body.

Further, in the above embodiment, the control unit 11 performs patch forming every predetermined period after starting a job. However, the control unit 11 may set the timing of patch forming according to the actual state of the image forming apparatus 1. For example, the control unit 11 may set the timing of patch forming based on an input reserved job and calculate the partial coverages and the overall coverage from the electrostatic latent image writing information accumulated within a predetermined period immediately before the timing. In this case, according to the state of the image forming apparatus 1 after start of the reserved job, the electrostatic latent image writing information based on another reserved job additionally input and/or the like, the timing of patch forming may be moved forward or postponed, the developer supply amount may be set again, and/or patch forming itself may be cancelled.

Further, in the above embodiment, the control unit 11 functions as the lubricant amount information obtaining unit too and obtains the overall coverage as the lubricant amount information. However, this is not a limit. That is, as long as the lubricant amount in the developing device 2*d* can be estimated, any can be used as the lubricant amount information obtaining unit.

For example, as the lubricant amount information obtaining unit, there may be provided a unit which directly measures the lubricant amount in the developing device 2*d* and obtains the measured value as the lubricant amount information. As such a measurement unit, for example, there is one configured to collect some of the developer in the developing device 2*d* and obtain the percentage of zinc in zinc stearate contained as the lubricant with an X-ray photoelectron spectrometer or the like.

Alternatively, as the lubricant amount information obtaining unit, for example, there may be provided a unit which obtains, as the lubricant amount information, the lubricant amount in the developing device 2*d* estimated from the developer amount supplied to the developing device 2*d*. As such a unit, for example, there is one configured to measure, at appropriate timing or intervals, the weight of a bottle to supply the developer into the developing device 2*d* and calculate the developer amount supplied to the developing device 2*d* from the amount of decrease in the weight of the bottle. Further, there is one configured to calculate the developer amount supplied to the developing device 2*d* from (i) operating time of a motor for carrying the developer from the bottle to the developing device 2*d* and/or (ii) the number of times the motor is operated.

Further, in the above embodiment, the developer supply amount for a patch is set based on the overall coverage and the partial coverage. However, this is not a limit. That is, the developer supply amount may be set based on the overall coverage only or based on the lubricant amount information which is not the overall coverage.

Further, in the above embodiment, at least one of the length of a patch in the rotation direction of the photoreceptor 2*a*, the dot pattern of a patch, the exposure amount, the developing bias, the number of patches to be formed and the frequency of patches is changed so as to cause the developing device 2*d* to supply the set developer supply amount of the developer. However, other factors may be changed so as to cause the developing device 2*d* to supply the set developer supply amount of the developer.

Further, in the above embodiment, the image forming apparatus 1 includes the pre-cleaning unit 2*f* which cleans the photoreceptor 2*a*. However, the pre-cleaning unit 2*f* may not be provided.

Further, in the above embodiment, the cleaning condition of the pre-cleaning unit 2*f* is controlled by changing at least one of the rotation speed of the pre-cleaning unit 2*f*, the bias to the pre-cleaning unit 2*f*, and the press amount of the pre-cleaning unit 2*f* to the photoreceptor 2*a*. However, the cleaning condition may be controlled by changing other factors. For example, the pre-cleaning unit 2*f* may be separated from the photoreceptor 2*a* so as not to clean the photoreceptor 2*a*.

Further, in the above embodiment, a patch(es) is formed between the image forming regions on the photoreceptor 2*a* with respect to the section having the partial coverage of a predetermined value or less. However, as long as it does not affect any user's desired image, a patch(es) may be formed in any no-image forming region.

EXAMPLES

Hereinafter, the present invention is described with Examples. However, the present invention is not limited thereto.

First Example

<<Preparation of Image Forming Apparatus 101>>

Prepared was an image forming apparatus 101 having almost the same configuration as the image forming apparatus 1 shown in FIG. 1, wherein the control unit 11 was configured to form no patch.

<<Preparation of Image Forming Apparatus 102>>

Prepared was an image forming apparatus 102 having almost the same configuration as the image forming apparatus 1 shown in FIG. 1, wherein the control unit 11 was configured to form a patch of a horizontally long belt-shaped solid pattern having a dot percentage corresponding to a coverage of 5% between image forming regions with respect to the $n^{th}$ section having the partial coverage Cn=0(%) among 12 sections into which the surface of the photoreceptor 2*a* is divided in the rotating shaft direction of the photoreceptor 2*a*.

<<Preparation of Image Forming Apparatus 103>>

Prepared was an image forming apparatus 103 having almost the same configuration as the image forming apparatus 1 shown in FIG. 1, wherein the control unit 11 was configured to form a patch of a horizontally long belt-shaped solid pattern having a dot percentage corresponding to a coverage of 10% between image forming regions with respect to the $n^{th}$ section having the partial coverage Cn=0 (%) among 12 sections into which the surface of the photoreceptor 2*a* is divided in the rotating shaft direction of the photoreceptor 2*a*.

<<Preparation of Image Forming Apparatus 104>>

The image forming apparatus 1 shown in FIG. 1 was configured as follows, thereby being prepared as an image forming apparatus 104.

That is, the control unit 11 was configured to form a patch of a horizontally long belt-shaped solid pattern having a dot percentage set based on the overall coverage Call, as shown in TABLE 1 below, between image forming regions with respect to the $n^{th}$ section having the partial coverage Cn=0 (%) among 12 sections into which the surface of the photoreceptor 2*a* is divided in the rotating shaft direction of the photoreceptor 2*a*.

<<Preparation of Image Forming Apparatus 105>>

An image forming apparatus 105 was prepared as follows.

First, in the image forming apparatus 104, the developer collection efficiency of the pre-cleaning unit 2*f* was measured as follows. That is, a solid image was formed on the photoreceptor 2*a*, the developer amount of the solid image was measured before and after the solid image passed through the pre-cleaning unit 2*f*, and the developer collection efficiency was calculated from its change amount. The calculated developer collection efficiency was 70%. The pre-cleaning unit 2*f* was connected to the earth (GND), the press amount of the brush of the pre-cleaning unit 2*f* to the photoreceptor 2*a* was 1 mm, and the rotation speed diffidence from the photoreceptor 2*a* was 1.8.

Then, in the image forming apparatus 104, the rotation speed difference from the photoreceptor 2*a* was reduced to 1.1, whereby the developer collection efficiency was changed to 35%, and the dot percentage of a patch to be formed based on the overall coverage Call was changed to the dot percentage shown in TABLE 1 below. Thus, the image forming apparatus 105 was prepared.

TABLE 1

| IMAGE FORMING APPARATUS No. | DOT PERCENTAGE OF PATCH [%] | | | | | | |
|---|---|---|---|---|---|---|---|
| | Call = 0 | Call = 3.5 | Call = 10.0 | Call = 25.0 | Call = 50.0 | Call = 70.0 | Call = 90.0 |
| 104 | 0 | 0 | 2.0 | 3.0 | 5.0 | 7.0 | 10.0 |
| 105 | 0 | 0 | 1.0 | 1.5 | 2.5 | 3.5 | 5.0 |

<<Evaluation of Image Forming Apparatuses 101 to 105>>

With respect to each of the prepared image forming apparatuses 101 to 105, evaluation of the lubricant amount and measurement and evaluation of the developer consumption amount were carried out as follows. The evaluation results are shown in TABLE 2.

(Evaluation of Lubricant Amount on Photoreceptor 2*a*)

Using each of the above image forming apparatuses 101 to 105, vertically long belt-shaped charts respectively having the overall coverages Call of 0%, 3.5%, 10%, 25%, 50%, 70% and 90% were each formed on 3,000 sheets of A4 paper in this order, namely, 21,000 sheets in total. As the developer, one containing zinc stearate as the lubricant was used. The width of a vertically long belt-shaped chart was changed, whereby the overall coverages Call of the vertically long belt-shaped charts mentioned above were obtained.

Each time the vertically long belt-shaped chart having one of the overall coverages Call was formed on 3,000 sheets, the lubricant amount on the white part having the partial coverage Cn=0(%) on the photoreceptor 2*a* was measured. When the measured value was equal to or less than a reference value, it was evaluated as ○ (circle; good), whereas when the measured value was more than the reference value, it was evaluated as x (cross; bad). The percentage (at %) of zinc in the zinc stearate obtained with an X-ray photoelectron spectrometer was used as the lubricant amount.

The above reference value was set as follows.

Using the image forming apparatus 1 shown in FIG. 1, a white solid image was continuously printed on sheets of paper with the developer containing zinc stearate as the lubricant, and the number of sheets for printing was changed, whereby the lubricant amount on the photoreceptor 2*a* was changed. The percentage (at %) of zinc in the zinc stearate obtained with an X-ray photoelectron spectrometer was used as the lubricant amount. As the number of sheets for printing increased, the lubricant amount on the photoreceptor 2*a* increased because the lubricant was repeatedly supplied from the developing device 2*d* onto the photoreceptor 2*a*.

The cleaning unit 2*g* was made to abut the photoreceptor 2*a* having the thus-changed lubricant amount thereon, and the drive torque (N·m) of the photoreceptor 2*a* was measured. Although the drive torque of the photoreceptor 2*a* having a small lubricant amount thereon was a small value because lubricity improved due to presence of the lubricant, once the lubricant amount on the photoreceptor 2*a* reached a certain value, the drive torque became high. The reason is contemplated that the photoreceptor 2*a* and the cleaning unit 2*g* came in close contact by increase in the lubricant amount on the photoreceptor 2*a*. If printing is continuously performed for a long time in this close contact state, wear of the cleaning unit 2*g* progresses.

From the relationship between the lubricant amount on the photoreceptor 2*a* and the drive torque thus obtained, the upper limit of the lubricant amount immediately before the drive torque increased was taken as the reference value.

(Measurement of Developer Consumption Amount)

The initial weight of a developer bottle disposed in the developing device 2*d* and the weight of the developer bottle after image forming on 21,000 sheets in total for measuring the lubricant amount on the photoreceptor 2*a* were measured with a weight scale, and the developer consumption amount was calculated therefrom. Difference in the developer consumption amount from the image forming apparatus 101 is shown in TABLE 2, taking the developer consumption amount of the image forming apparatus 101 as 0. When the difference from the image forming apparatus 101 is 0.3 or more, it can be judged that the developer consumption amount is too much.

TABLE 2

| IMAGE FORMING APPARATUS No. | EVALUATION OF LUBRICANT AMOUNT ON PHOTORECEPTOR | | | | | | | DEVELOPER | |
|---|---|---|---|---|---|---|---|---|---|
| | Call = 0 | Call = 3.5 | Call = 10.0 | Call = 25.0 | Call = 50.0 | Call = 70.0 | Call = 90.0 | CONSUMPTION AMOUNT [kg] | REMARK |
| 101 | ○ | ○ | ○ | X | X | X | X | 0 | COMPARATIVE EXAMPLE |
| 102 | ○ | ○ | ○ | ○ | ○ | X | X | 0.24 | COMPARATIVE EXAMPLE |
| 103 | ○ | ○ | ○ | ○ | ○ | ○ | ○ | 0.48 | COMPARATIVE EXAMPLE |
| 104 | ○ | ○ | ○ | ○ | ○ | ○ | ○ | 0.28 | PRESENT INVENTION |
| 105 | ○ | ○ | ○ | ○ | ○ | ○ | ○ | 0.14 | PRESENT INVENTION |

As to the image forming apparatus 101, the lubricant amount on the white part was more than the reference value when the overall coverage Call=25(%) or higher.

As to the image forming apparatus 102, because the developer of the patch formed on the photoreceptor 2*a* was supplied to the cleaning unit 2*g*, the lubricant amount on the white part was equal to or less than the reference value even when the image having the overall coverage Call=25(%) was formed. However, when the overall coverage Call was higher, the lubricant amount on the white part became larger, and it is assumed that when the image having the overall coverage Call=70(%) or higher was formed, the developer amount accumulating at the cleaning unit 2*g* became insufficient, and the lubricant scraping-away power became insufficient, so that the lubricant amount on the white part became more than the reference value.

As to the image forming apparatus 103, because the developer amount of the patch was sufficient, even when the overall coverage Call=90(%), the developer amount accumulating at the cleaning unit 2*g* was sufficient, and the lubricant scraping-away power was sufficient, so that the lubricant amount on the white part was made to be low. However, the developer consumption amount increased by 0.48 kg from that of the image forming apparatus 101 and was about twice as large as that of the image forming apparatus 102.

As to the image forming apparatus 104, because the dot percentage of a patch was changed according to the overall coverage Call as shown in TABLE 1, even when the image having the overall coverage Call=70(%) or higher was formed, a sufficient amount of the developer was supplied to the cleaning unit 2*g*, so that the lubricant amount on the white part was made to be low. Further, because the developer supply amount for a patch was set at a small value when the overall coverage Call was low, the developer consumption amount was approximately the same as that of the image forming apparatus 102, and hence it can be said that the developer consumption amount was made to be low.

As to the image forming apparatus 105, the dot percentage of a patch was changed according to the overall coverage Call as shown in TABLE 1, thereby being a half of that as to the image forming apparatus 104. Consequently, as to the image forming apparatus 105, the developer supply amount for a patch became smaller, but, as described above, the developer collection efficiency of the pre-cleaning unit 2*f* decreased, and hence the developer of the patch easily reached the cleaning unit 2*g*, without being collected by the pre-cleaning unit 2*f*. It is assumed that although the developer supply amount for a patch was small, the developer amount supplied to the cleaning unit 2*g* was sufficient, so that the sufficient lubricant scraping-away power was obtained, and the lubricant amount on the white part was made to be low. Thus, the image forming apparatus 105 can further reduce the developer consumption amount.

Second Example

<<Preparation of Image Forming Apparatus 201>>

Prepared was an image forming apparatus 201 having the same configuration as the image forming apparatus 104 in First Example.

<<Preparation of Image Forming Apparatus 202>>

The image forming apparatus 1 shown in FIG. 1 was configured as follows, thereby being prepared as an image forming apparatus 202.

That is, the control unit 11 was configured to form a patch of a horizontally long belt-shaped solid pattern having a dot percentage set based on the partial coverage Cn and the overall coverage Call, as shown in TABLE 3 below, between image forming regions with respect to each of 12 sections into which the surface of the photoreceptor 2*a* is divided in the rotating shaft direction of the photoreceptor 2*a*.

TABLE 3

| | Call = 10 | Call = 25 | Call = 70 |
|---|---|---|---|
| 10.0 ≤ Cn | 0% | 0% | 0% |
| 5.0 < Cn < 10.0 | 0% | 0% | 2.0% |
| 3.5 < Cn ≤ 5.0 | 0.3% | 0.7% | 4.0% |
| 2.0 < Cn ≤ 3.5 | 0.5% | 1.5% | 5.0% |
| 0 ≤ Cn ≤ 2.0 | 2.0% | 3.0% | 7.0% |

<<Evaluation of Image Forming Apparatuses 201 and 202>>

Using each of the above image forming apparatuses 201 and 202, vertically long belt-shaped charts respectively having overall coverages Call of 10%, 25% and 70% were each formed on 5,000 sheets of A4 paper in this order, namely, 15,000 sheets in total. As the developer, one containing zinc stearate as the lubricant was used. The width of a vertically long belt-shaped chart was changed, whereby the overall coverages Call of the vertically long belt-shaped charts mentioned above were obtained.

The initial weight of the developer bottle disposed in the developing device 2*d* and the weight of the developer bottle after image forming on 15,000 sheets in total were measured with the weight scale, and the developer consumption amount was calculated therefrom. Difference in the developer consumption amount from the case where no patch was formed is shown in TABLE 4, taking the developer consumption amount of the case where no patch was formed as 0.

TABLE 4

| IMAGE FORMING APPARATUS No. | DEVELOPER CONSUMPTION AMOUNT [kg] | REMARK |
|---|---|---|
| 201 | 0.11 | PRESENT INVENTION |
| 202 | 0.06 | PRESENT INVENTION |

From each of the sections on the photoreceptor 2*a*, the developer was supplied to the cleaning unit 2*g* according to the partial coverage Cn of the vertically long belt-shaped chart. Hence, in the image forming apparatus 202, as the partial coverage Cn of the $n^{th}$ section was higher, the dot percentage of a patch for the $n^{th}$ section was made smaller and accordingly the developer supply amount therefor was set at a smaller value. Thereby, the image forming apparatus 202 was able to further reduce the developer consumption amount as compared with the image forming apparatus 201, which set the developer supply amount for a patch based on the overall coverage Call only.

With respect to each of the image forming apparatuses 201 and 202, after image forming on 15,000 in total, the lubricant amount in the $n^{th}$ section having the low partial coverage Cn on the photoreceptor 2*a* was evaluated in the same manner as First Example. The lubricant amount was equal to or less than the reference value in any case.

What is claimed is:

1. An image forming apparatus comprising:

an image carrying member;

a developing device which develops an electrostatic latent image formed on the image carrying member with a developer containing a toner and a lubricant;

a cleaning unit which cleans the image carrying member by pressing in contact with the image carrying member; and a hardware processor which obtains, with respect to each of sections formed by dividing a surface of the image carrying member in a rotating shaft direction of the image carrying member, a partial coverage indicating a percentage of a developer adhesion area from electrostatic latent image writing information for a predetermined period about the section, obtains, as lubricant amount information on a lubricant amount in the developing device, an overall coverage which is a sum of the partial coverages of the respective sections, sets a developer supply amount for a patch to be formed outside an image forming region on the image carrying member, based on (i) the partial coverage calculated for a section having the partial coverage of a predetermined value or less among the sections and (ii) the overall coverage, sets the developer supply amount in such a way as to be larger as the overall coverage is higher and to be smaller as the partial coverage of the section is higher, and causes the developing device to supply the set developer supply amount of the developer so that the patch is formed.

2. The image forming apparatus according to claim 1, wherein the hardware processor changes at least one of a length of the patch in a rotation direction of the image carrying member, a dot pattern of the patch, an exposure amount, a developing bias, a number of the patch to be formed and a frequency of the patch so as to cause the developing device to supply the set developer supply amount of the developer.

3. The image forming apparatus according to claim 1, further comprising a transfer device which transfers a toner image on the image carrying member formed by the developing device performing the development, wherein the cleaning unit cleans the image carrying member after the transfer device performs the transfer, and the hardware processor controls a transfer condition of the transfer device such that a developer remaining percentage of the patch after the patch passes through the transfer device is larger than a developer remaining percentage of the toner image excluding the patch after the toner image excluding the patch is transferred to paper.

4. The image forming apparatus according to claim 3, further comprising a pre-cleaning unit which is disposed between the transfer device and the cleaning unit in a rotation direction of the image carrying member and cleans the image carrying member, wherein the cleaning unit cleans the image carrying member after the pre-cleaning unit cleans the image carrying member, and the hardware processor controls a cleaning condition of the pre-cleaning unit such that the developer remaining percentage of the patch after the patch passes through the pre-cleaning unit is larger than the developer remaining percentage of the toner image excluding the patch after the toner image excluding the patch is cleaned by the pre-cleaning unit.

5. The image forming apparatus according to claim 4, wherein the pre-cleaning unit is a rotatable member which cleans the image carrying member by being pressed on the surface of the image carrying member, and the hardware processor controls the cleaning condition of the pre-cleaning unit by changing at least one of a rotation speed of the pre-cleaning unit, a bias to the pre-cleaning unit and a press amount of the pre-cleaning unit to the image carrying member.

6. The image forming apparatus according to claim 1, wherein the patch is formed between one of the image forming region and another of the image forming region on the image carrying member with respect to the section having the partial coverage of the predetermined value or less.

7. The image forming apparatus according to claim 1, wherein the hardware processor obtains the partial coverage from at least one of the electrostatic latent image writing information for the predetermined period in a past and the electrostatic latent image writing information for the predetermined period in a future based on a reserved job.

8. An image forming method of an image forming apparatus including: an image carrying member; a developing device which develops an electrostatic latent image formed on the image carrying member with a developer containing a toner and a lubricant; and a cleaning unit which cleans the image carrying member by pressing in contact with the image carrying member, the image forming method comprising:

a patch forming step of (i) obtaining, with respect to each of sections formed by dividing a surface of the image carrying member in a rotating shaft direction of the image carrying member, a partial coverage indicating a percentage of a developer adhesion area from electrostatic latent image writing information for a predetermined period about the section, (ii) obtaining, as lubricant amount information on a lubricant amount in the developing device, an overall coverage which is a sum of the partial coverages of the respective sections, (iii) setting a developer supply amount for a patch to be formed outside an image forming region on the image carrying member, based on the partial coverage calculated for a section having the partial coverage of a predetermined value or less among the sections and (b) the overall coverage, (iv) setting the developer supply amount in such a way as to be larger as the overall coverage is higher and to be smaller as the partial coverage of the section is higher, and (v) causing the developing device to supply the set developer supply amount of the developer so that the patch is formed.

9. A non-transitory computer readable storage medium storing a program to cause a computer to perform the image forming method according to claim 8.

10. The non-transitory computer readable storage medium according to claim 9, wherein in the patch forming step, at least one of a length of the patch in a rotation direction of the image carrying member, a dot pattern of the patch, an exposure amount, a developing bias, a number of the patch to be formed and a frequency of the patch is changed so as to cause the developing device to supply the set developer supply amount of the developer.

11. The non-transitory computer readable storage medium according to claim 9, wherein the image forming apparatus further includes a transfer device which transfers a toner image on the image carrying member formed by the developing device performing the development, the cleaning unit cleans the image carrying member after the transfer device performs the transfer, and in the patch forming step, a transfer condition of the transfer device is controlled such that a developer remaining percentage of the patch after the patch passes through the transfer device is larger than a developer remaining percentage of the toner image excluding the patch after the toner image excluding the patch is transferred to paper.

12. The non-transitory computer readable storage medium according to claim 11, wherein the image forming apparatus further includes a pre-cleaning unit which is disposed between the transfer device and the cleaning unit in a rotation direction of the image carrying member and cleans the image carrying member, the cleaning unit cleans the image carrying member after the pre-cleaning unit cleans the image carrying member, and in the patch forming step, a cleaning condition of the pre-cleaning unit is controlled such that the developer remaining percentage of the patch after the patch passes through the pre-cleaning unit is larger than the developer remaining percentage of the toner image excluding the patch after the toner image excluding the patch is cleaned by the pre-cleaning unit.

13. The non-transitory computer readable storage medium according to claim 12, wherein the pre-cleaning unit is a rotatable member which cleans the image carrying member by being pressed on the surface of the image carrying member, and in the patch forming step, the cleaning condition of the pre-cleaning unit is controlled by changing at least one of a rotation speed of the pre-cleaning unit, a bias to the pre-cleaning unit and a press amount of the pre-cleaning unit to the image carrying member.

14. The non-transitory computer readable storage medium according to claim 9, wherein the patch is formed between one of the image forming region and another of the image forming region on the image carrying member with respect to the section having the partial coverage of the predetermined value or less.

15. The non-transitory computer readable storage medium according to claim 9, wherein in the patch forming step, the partial coverage is obtained from at least one of the electrostatic latent image writing information for the predetermined period in a past and the electrostatic latent image writing information for the predetermined period in a future based on a reserved job.

* * * * *